United States Patent [19]

Brooke

[11] 4,026,541

[45] May 31, 1977

[54] SHEET STRIPPING DEVICE

[75] Inventor: Edric R. Brooke, Welwyn Garden City, England

[73] Assignee: Xerox Corporation, Stamford, Conn.

[22] Filed: Sept. 17, 1975

[21] Appl. No.: 614,036

[30] Foreign Application Priority Data

Oct. 25, 1974 United Kingdom ..... 46240/74

[52] U.S. Cl. ..... 271/174; 271/DIG. 2

[51] Int. Cl.[2] ..... B65H 29/56

[58] Field of Search ..... 271/DIG. 2, 80, 174; 118/245; 34/120; 355/3 R

[56] References Cited

UNITED STATES PATENTS

| | | | |
|---|---|---|---|
| 3,804,401 | 4/1974 | Stange | 271/DIG. 2 |
| 3,824,011 | 7/1974 | Suzuki et al. | 271/174 |
| 3,947,019 | 3/1976 | Tanaka et al. | 271/DIG. 2 |
| 3,955,916 | 5/1976 | Bar-on | 271/DIG. 2 |

*Primary Examiner*—Robert W. Saifer

[57] ABSTRACT

A method and apparatus for stripping sheets from a cylindrical surface by means of a filament stretched across the drum at an angle to the lead edge of the sheet whereby one corner of the sheet is initially contacted by the filament.

1 Claim, 12 Drawing Figures

SHEET STRIPPING DEVICE

This invention generally relates to electrostatographic apparatus and more particularly concerns a method and means for stripping imaged sheets from an imaging surface.

In one well known form of automatic electrostatographic reproduction machine, a moving photoconductive plate or photoreceptor, generally in the form of an endless surface, such as a drum or the like, is uniformly charged and the surface then exposed to a light pattern of the image sought to be reproduced to thereby discharge the plate in the areas where light strikes the plate. The undischarged areas of the plate thus form an electrostatic charge pattern in conformity with the configuration of the original image pattern.

This electrostatic latent image may then be developed into visible form by applying a developer material, either a powder or liquid to the plate using any one of a number of development means generally known and used in the art. Subsequent to the development operation, the now visible image is transferred from the plate to a sheet of final support material, or carrier, such as paper or the like, and suitably affixed thereto, thereby forming a permanent print.

The transfer step includes bringing the developed photoreceptor surface into contact with the surface of the image support material, effecting the transposition of the developed image from the photoreceptor surface to the support material surface by suitable means while the two are in contact and separating the imaged bearing carrier sheet from the photoreceptor.

Because of the strong electrostatic attraction between the carrier sheet and the photoreceptor, separation cannot depend upon gravity but requires an additional external force. An example of a proposed means used to provide this external stripping force includes thin wedge-like fingers which are inserted between the carrier paper and the drum. Also proposed is the use of a fluid stream such as air which is directed toward the photoreceptor surface and the lead edge of the carrier in the stripping zone.

When a stripping finger is used to strip, it is common to allow it to contact the photoreceptor surface, in which case it is possible that particles of the developer material, which for one reason or other did not transfer to the carrier sheet, may collect on the side of the finger that is not in contact with the carrier sheet. This accumulation of material may cause cleaning problems and interfere with the efficient functioning of the stripping finger. Also, the contact of the hard, blade-like finger with the photoreceptor tends to cause wear in the areas of contact, which wear may affect the quality of the copy produced.

When fluids such as air are used alone to provide the stripping force, a very high pressure must be used at least for the initial separation of the forward edge of the carrier sheet from the photoreceptor surface. This high pressure air may cause any loose particles of material that are present to be blown around the inside of the machine, thereby increasing the possibility of their causing wear and requiring extra cleaning of the machine.

According to one aspect of the present invention, there is provided a device for stripping sheet material from a surface moving relative thereto including a flexible filament means disposed across the surface at an acute angle to the direction of relative movement therebetween and having at least a portion thereof in general line contact with the surface.

According to another aspect of the invention, there is provided a method of stripping a sheet of material from a surface including the steps of placing at least a portion of a filament means in general line contact with a sheet material carrying surface at an acute angle to the direction of relative movement therebetween and moving the filament means and sheet material carrying surface relative to each other to cause the filament means to initially contact at least a portion of the forward edge of the sheet material and pass between the sheet material and the carrying surface whereby the sheet material will be stripped off the surface.

In order that the invention may be more fuly understod, a preferred embodiment thereof is described with reference to the accompanying drawings wherein.

Figure 1:
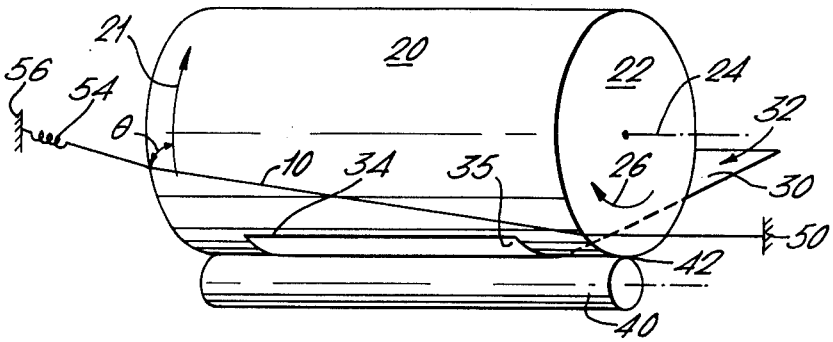
FIG. 1 is a schematic, perspective view showing the filament stripping means in use with a cylindrically shaped sheet material carrying surface.

Referring to FIG. 1, there may be seen a sheet material carrying surface 20, here shown on the outside of a generally cylindrical drum 22. The drum, which may in practice be the photoreceptor in an electrostatographic copying machine, may be rotatable about a central axis 24 in a direction indicated by the arrow 26 thereby causing the surface 20 to move in a direction indicated by the arrow 21. A piece of flat sheet material 30 of generally uniform predetermined thickness moves in the direction indicated by the arrow 32 and is brought into contact with the surface 20 at a point 42 by means represented for example, by roller 40. The sheet material may be caused to be attracted to the surface 20, by for example, applying an electrical bias transfer charge to the roller 40 as has been proposed in photocopying machines. With the sheet material 30 attracted to the surface 20, the sheet material will remain in contact with the surface 20 beyond the point 42 as shown in FIG. 1 by a forward edge 34 and will not normally peel off under the force of gravity.

According to the invention, a simple and reliable means for stripping the sheet material 30 from the surface 20 is provided by extending a flexible filament means 10 across the surface 20 and bringing it into general line contact with the surface 20 at the time it is approached by the sheet material forward edge 34. Preferably the filament means 10 is disposed across the surface 20 at an angle $\theta$ to the direction of relative movement therebetween as indicated by the arrow 21. The angle $\theta$ preferably is less than 90° and may include a range between that shown, for example, in FIGS. 1 and 4.

Figure 2:
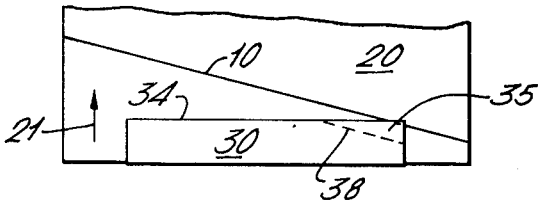
FIG. 2 is a front elevational view of the surface of FIG. 1 showing the stripper filament contacting the forward edge of a sheet, lifting the sheet or causing the sheet to buckle at the corner.

In the position shown in FIG. 2 the generally taut filament means 10 contacts a corner 35 of the sheet 30 which has its forward edge 34 lying in a plane that is generally perpendicular to the direction 21 of relative movement therebetween.

Figure 3:
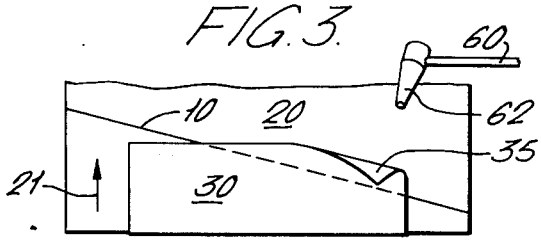
FIG. 3 is a view similar to FIG. 2 at a later point in time showing the sheet moving away from the surface, schematically shown being assisted by low pressure air.

When the forward edge 34 at the corner 35 contacts the filament means 10 in its movement, shown by the arrow 21, the sheet material will lift over the filament straightway or bow upwardly to initially form a buckle represented by the dotted line 38 at the corner 35. Such a buckle will increase in size until the forces built up in the sheet material by the buckling cause it to snap over the filament means 10 whereafter the remainder of the forward edge 34 will ride over the filament means 10 following the corner 35 as shown in FIG. 3. This continues as the drum 22 rotates until the filament means 10 has passed completely between surface 20 and the sheet material 30. Supplemental stripping means may be provided as will be explained hereinafter.

Figure 5:
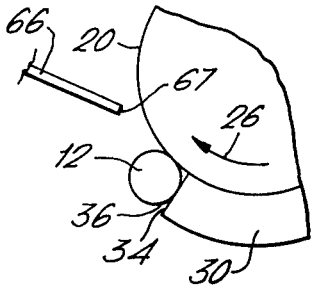
FIG. 5 is a schematic representation of the relationship between a filament means and the forward edge of a sheet of paper as seen in cross-section.

According to the invention the transverse cross-sectional configuration of the filament means 10 is preferably round as shown at 12 in FIG. 5. This, it has been found, provides the advantage that it will function equally well regardless of the particular points thereof which lie on the surface 20 and contact the forward edge 34. Moreover, in use, the filament 12 may have a tendency to give and rotate as the forward edge 34 buckles, which movement will aid the passage of the sheet material 30 thereover. Movement of the filament over the photoreceptor may, depending on the particular filament and sheet material characteristics, cause the filament to roll along the surface 20 thereby resulting in an upward force component on the forward edge 34 which will tend to cause the forward edge 34 to ride up and over the filament 12. Movement and rotation serves to prevent any accumulation of extraneous developer material thereon and provides a self-cleaning function. Nevertheless it is within the contemplation of the invention to employ filament means of other, non-circular cross-sectional configurations.

Figure 4:
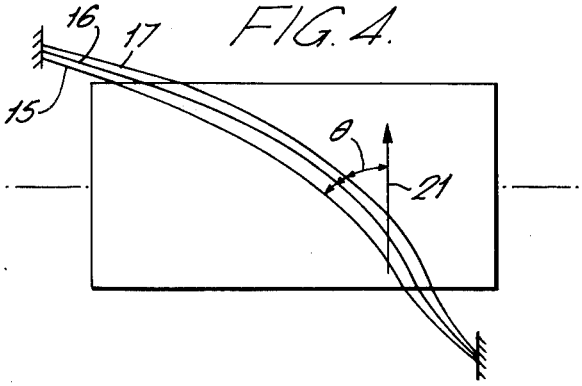
FIG. 4 is a view showing the filament means arranged at an angle of less then 45° with the direction of movement.
Figure 8:
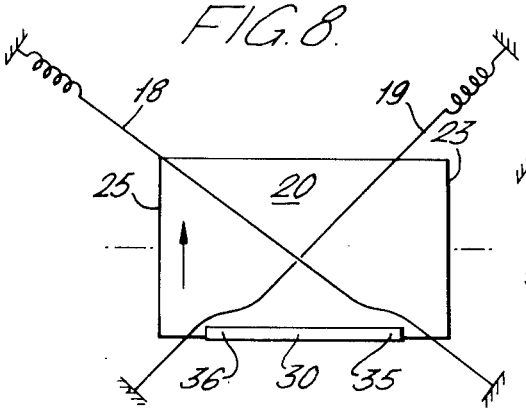
FIGS. 8 and 9 illustrate a pair of filament means in a cross configuration.

The filament means may include one or more filaments or threads. When a plurality of filaments are used they may be disposed in various relationships to each other. These may range from the general parallel arrangement as shown in FIG. 4 at 15, 16 and 17, to the criss-crossed position as shown in FIG. 8 at 18 and 19. Although the members 15, 16 and 17 in FIG. 4 are each shown in contact with the surface 20 completely across the expected path of travel of sheet material 30, it is contemplated that, for example, only the portion of filament 15 expected to contact corner 35 need be in contact with the surface 20. The remainder of filament 15 and the filaments 16 and 17 may be positioned in spaced relation thereto to function as a guide to the portion of the moving sheet material which has been stripped. In fact, for this purpose the members 16 and 17 need not be parallel to the member 15.

When the filament members 15, 16 and 17 are each in contact with the surface 20, at least in the area of corner 35, the members 16 and 17 provide a back-up should the member 15 break or somehow not separate the corner. The members 15, 16 or 17 may be of the same or different cross-sectional configuration and need not necessarily be arranged in parallel or equally spaced relationship.

The relationship between the size of the filament member 12 and the thickness of the sheet material 30 may be seen in FIG. 5. Advantageous results are obtained where the thickness, here the diameter, of the member 12 is generally equal to or less than the expected thickness of the sheet material 30. For example, in electrostatic copying machines, the normally used paper is generally uniformly about 0.0035 inches thick so in that situation, the thickness of the member 12 may be about 0.0035 or less. This thickness places the lines of force at the point of contact 36 between the member 12 and forward edge 34 generally at or below the center of the forward edge. Depending upon the roll characteristics of the member 12 and its ability to impart an upward force to the forward edge 34 during such roll, the size of the member 12 may be larger. Also, when the forward edge may be normally expected to be slightly raised from the surface 20 by some means, the criticality of the size of member 12 will be accordingly reduced.

Contact between the member 12 and edge 34 where point 36, as shown in FIG. 5, is at or below the center of thickness of the sheet 30, presents a greater likelihood that the edge 34 will ride up and over the filament member 12.

Materials which will provide the necessary strength for this size of filament members 12 include cotton, nylon, either monofilament or woven, and high tensile strength metal wires such as stainless steel. The filament means may be coated. Other shapes of filament means may be made of a similar material. The expected conditions of use and availability of materials must be considered in determining the most advantageous design.

Disposing the filament means 10 across the surface 20 at an acute angle to the direction of movement 21 provides an additional advantage in the fact that a greater length of filament may be put in contact with the surface 20 to allow the filament means 10 to conform more closely to the cylindrical surface 20 than would be possible if the angle were 90°. Carrying this further it may be seen in FIG. 4 that the filament means will extend around a greater portion of the surface 20 and more readily overcome any variances in the surface thereof.

Figure 6:
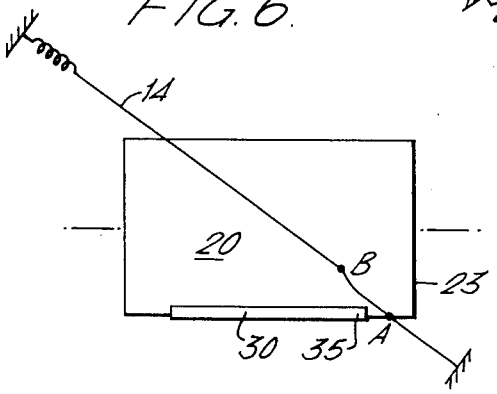
FIGS. 6 and 7 are shematic illustrations of the filament means positioned inwardly of the cylindrical surface edge.
Figure 7:
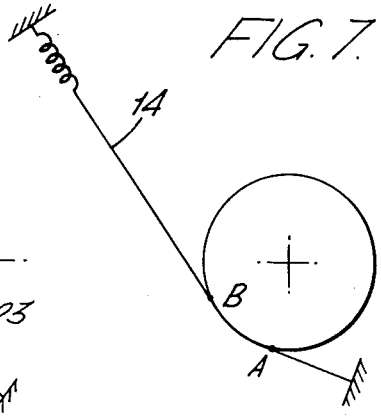

Referring to FIGS. 6 and 7 it can be seen that the filament member 14 may be positioned to leave the cylindrical surface 20 before reaching a peripheral corner 23. This portion will avoid abrasion of the edge 23 on the taut member 14. These figures also clearly illustrate that contact of the member 14 with the surface 20 may only occur as shown between points A and B in the area adjacent the corner at which the initial stripping will occur, here corner 35. The remainder of member 14 in the expected path of travel of 30 will function as a guide insuring separation of the material 30.

Figure 9:
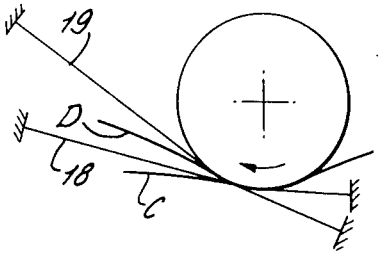

Again in FIGS. 8 and 9, contact of the filament members 18 and 19 with the surface 20 is inwardly of the peripherial edges 23, 25. In this embodiment, the first filament member 18 is positioned to initially contact one end of the forward edge 34 or corner 35 and the second filament member 19 is positioned to thereafter subsequently contact the other end 36. With this arrangement there are two opportunities to strip the sheet material 30. Thus, when the member 18 passes between the surface 20 and corner 35 and a little later the member 19 passes between the surface 20 and corner 36, the member 30 will be stripped as shown at C in FIG. 9. If the sheet material 30 goes under member 18 somehow and member 19 strips corner 36, the sheet 30 will feed up through the filament members as shown at D in FIG. 9.

The separation of the sheet material 30 from the surface 20 by the means 10 should in most cases be sufficient to break the electostatic attraction between the two and cause the material to peel off as shown in FIG. 3. Nevertheless a significant advantage of the present invention is that it lends itself very well to the inclusion of a fail-safe back-up means to ensure that the stripping continues. One such back-up means is a low pressure air supply, schematically represented in FIG. 3 at 60, directed by a suitable nozzle 62 toward the point where the sheet material leaves the surface. It should be aimed to flow between the surface 20 and sheet 30 to apply a force moving them apart and assuring that the sheet material remains separated from the surface once it passes the stripping filament.

Another possible back-up means shown in FIG. 5 includes a guide means 66 having a forward edge 67 positioned after the filament member 12 and spaced from the surface 20. It is placed so that as the buckle of the corner 35 snaps over the filament 12 and away from the suface 20, the edge 67 will be behind the sheet material and assure its movement along the desired path.

Figure 10:
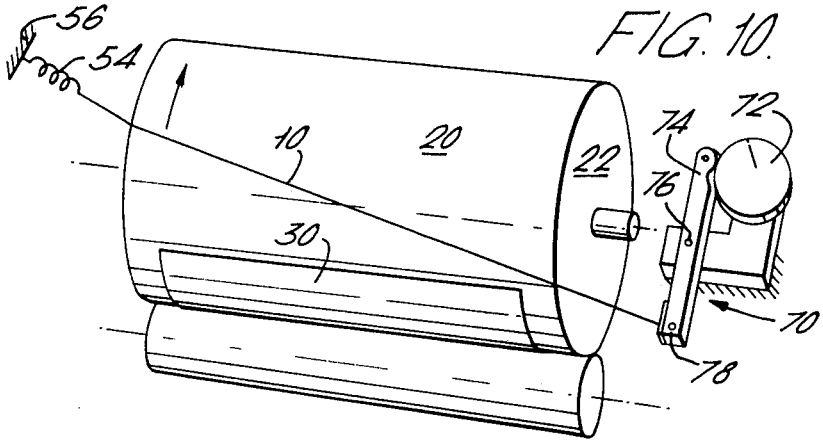
FIGS. 10 and 11 are schematic representations of two different embodiments of means to de-tension the filament when it is not in use.

Mounting of the filament means 10 should provide sufficient tension to hold it taut and in general line contact with the surface 20. As shown in FIG. 1, one end of the filament means 10 may be attached to a fixed mounting 50 on one side of the surface 20 and the other end may be connected by way of a spring means 54 to a support 56 on the opposite side of the surface. Suitable means may be provided to adjust the tension on the filament 10. As shown in FIG. 10 one such means generally indicated at 70 includes a rotating cam 72 having a follower arm 74 pivoted at a point 76 and connected at is opposite end 78 to the filament means 10. Thus as cam 72 rotates in timed relation to the movement of drum 22 and the flow of paper 30, the filament 10 will be tensioned just before the forward edge 34 approaches. Tension may be released just after sheet 30 passes.

Figure 11:
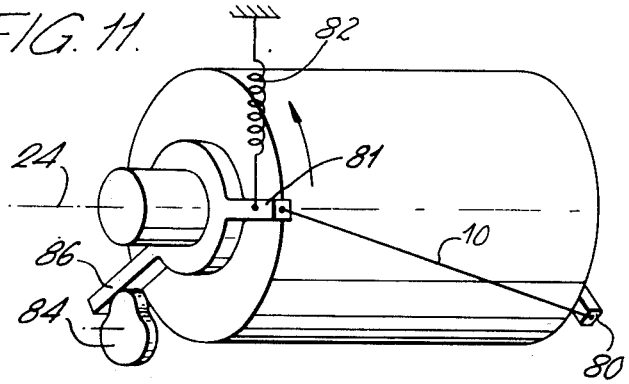

Tensioning of the filament may be obtained with the structure shown in FIG. 11 where one end of the filament means 10 is fixed to a support 80 and the other is attached to an arm 81 that rotates about the axis 24. A spring 82 connected to the arm 81 exerts a force which tensions the filament means 10. Release of the tension is accomplished by a synchronized cam 84 bearing against an extension 86 of arm 81.

Figure 12:
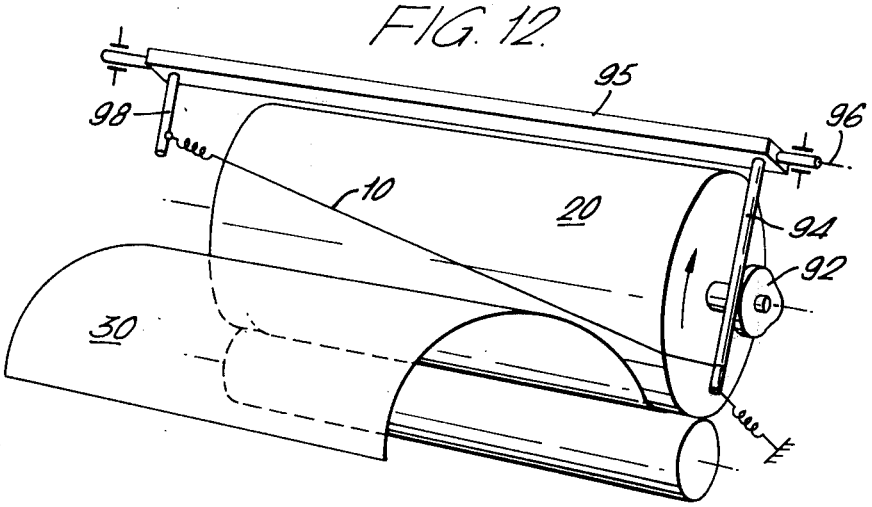
FIG. 12 is a schematic representation of an embodiment of a means to lift the filament from the drum when the filament is not in use.

Movement of the filament means 10 completely out of contact with the surface 20 may be effected by the structure shown in FIG. 12 where a cam 92 rotates on axis 24 and moves a follower arm 94 that pivots a rod 95 about an axis 96. An arm 98 is connected to rod 95 so that 94 and 98 move in relation to each other and lift the filament means 10, inter-connected therebetween, into and out of contact with the surface 20.

From the foregoing it will be understood that I have provided a simple and reliable stripping means and method that overcomes the disadvantages of the prior art. It will also be appreciated that various modifications may be made to the specific details referred to herein without departing from the scope of the invention as defined in the appended claims.

What is claimed is:

1. A device for stripping sheet material from a surface moving relative thereto including:

flexible filament means disposed across the surface at an acute angle to the direction of relative movement therebetween and having at least a portion thereof in general line contact with the surface, said filament means being connected to spring means on one end, said spring means holding said filament means in tension and allowing lateral displacement thereof in response to engagement with said sheet material.

* * * * *